US008408755B2

(12) United States Patent
Quadri et al.

(10) Patent No.: US 8,408,755 B2
(45) Date of Patent: Apr. 2, 2013

(54) STAGE LIGHTING FIXTURE AND METHOD OF OPERATING A STAGE LIGHTING FIXTURE

(75) Inventors: Pasquale Quadri, Torre de' Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 247 days.

(21) Appl. No.: 12/877,607

(22) Filed: Sep. 8, 2010

(65) Prior Publication Data

US 2011/0063847 A1 Mar. 17, 2011

(30) Foreign Application Priority Data

Sep. 11, 2009 (IT) ..... MI2009A1563

(51) Int. Cl.
*F21V 9/00* (2006.01)
*F21V 14/08* (2006.01)

(52) U.S. Cl. ..... 362/321; 362/293; 362/281

(58) Field of Classification Search ..... 362/317, 362/321, 277, 293, 281; 353/97
See application file for complete search history.

(56) References Cited

U.S. PATENT DOCUMENTS

| | | | | |
|---|---|---|---|---|
| 3,940,606 A | | 2/1976 | Lemons | |
| 4,317,613 A | * | 3/1982 | Grosser | 359/370 |
| 4,890,208 A | * | 12/1989 | Izenour | 362/294 |
| 4,899,267 A | * | 2/1990 | Mardon | 362/277 |
| 5,590,955 A | * | 1/1997 | Bornhorst et al. | 362/324 |
| 5,788,365 A | * | 8/1998 | Hunt et al. | 362/301 |
| 6,744,693 B2 | * | 6/2004 | Brockmann et al. | 362/321 |

FOREIGN PATENT DOCUMENTS

| | | |
|---|---|---|
| DE | 517056 | 3/1929 |
| DE | 10229012 | 1/2004 |
| EP | 1001210 | 5/2000 |
| EP | 1158239 | 11/2001 |
| EP | 1482240 | 12/2004 |
| GB | 304274 | 10/1929 |

* cited by examiner

*Primary Examiner* — Peggy A. Neils
(74) *Attorney, Agent, or Firm* — Leason Ellis LLP

(57) ABSTRACT

A stage lighting fixture has a casing having a closed first end and an open second end; a light source housed inside the casing, close to the first end, to emit a light beam along an optical axis oriented longitudinally with respect to the casing; an objective optical system located along the optical axis, at the second end of the casing, and having a focus position; a circular-aperture diaphragm located along the optical axis, between the light source and the objective optical system, to intercept the beam; and an iris diaphragm located along the optical axis, between the light source and the objective optical system, and which can be set to the focus position.

16 Claims, 4 Drawing Sheets

STAGE LIGHTING FIXTURE AND METHOD OF OPERATING A STAGE LIGHTING FIXTURE

The present invention relates to a stage lighting fixture, and to a method of operating a stage lighting fixture.

BACKGROUND OF THE INVENTION

As is known, a stage lighting fixture comprises a casing housing a light source, beam filtering and profiling means, and an objective lens.

The casing extends along a longitudinal axis, is open at one end, and is closed at the opposite end, where the light source is located. In actual use, the light source, e.g. a halogen lamp, emits a beam substantially along the optical axis of the lighting fixture, which normally coincides with the longitudinal axis of the casing.

The beam filtering and profiling means are located between the light source and the objective lens to intercept the beam, are designed to produce special beam effects, and comprise, for example, beam colouring assemblies, a diaphragm, a number of gobos, and other lighting effect devices.

The diaphragm comprises a plurality of movable leaves fitted to an annular support and substantially located (overlapping) in a plane perpendicular to the optical axis. The leaves are arranged to form a substantially flat shield with a regular-polygon-shaped or circular central aperture, of which each leaf defines a side (or arc), and are movable jointly by a control and actuator to adjust the size of the central aperture. The diaphragm may be used as a dimmer or profiler to adjust the brightness or size of the lighting fixture beam respectively.

Gobos are disks, normally of stainless steel or glass, shaped or patterned to produce given lighting effects when they intercept the beam.

The objective lens is located at the open end of the casing, is substantially perpendicular to the optical axis, and is movable to adjust its focus position with respect to the beam filtering and profiling means.

Known lighting fixtures provide for a fairly wide, but somewhat limited, range of lighting effects. For example, the devices normally featured in lighting fixtures are unsuitable for projecting variable-sized shapes other than convex polygons.

SUMMARY OF THE INVENTION

It is an object of the present invention to provide a stage lighting fixture, and a method of operating a stage lighting fixture, designed to produce a wider range of lighting effects.

According to the present invention, there are provided a stage lighting fixture, and a method of operating a stage lighting fixture, as claimed in the attached Claims.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
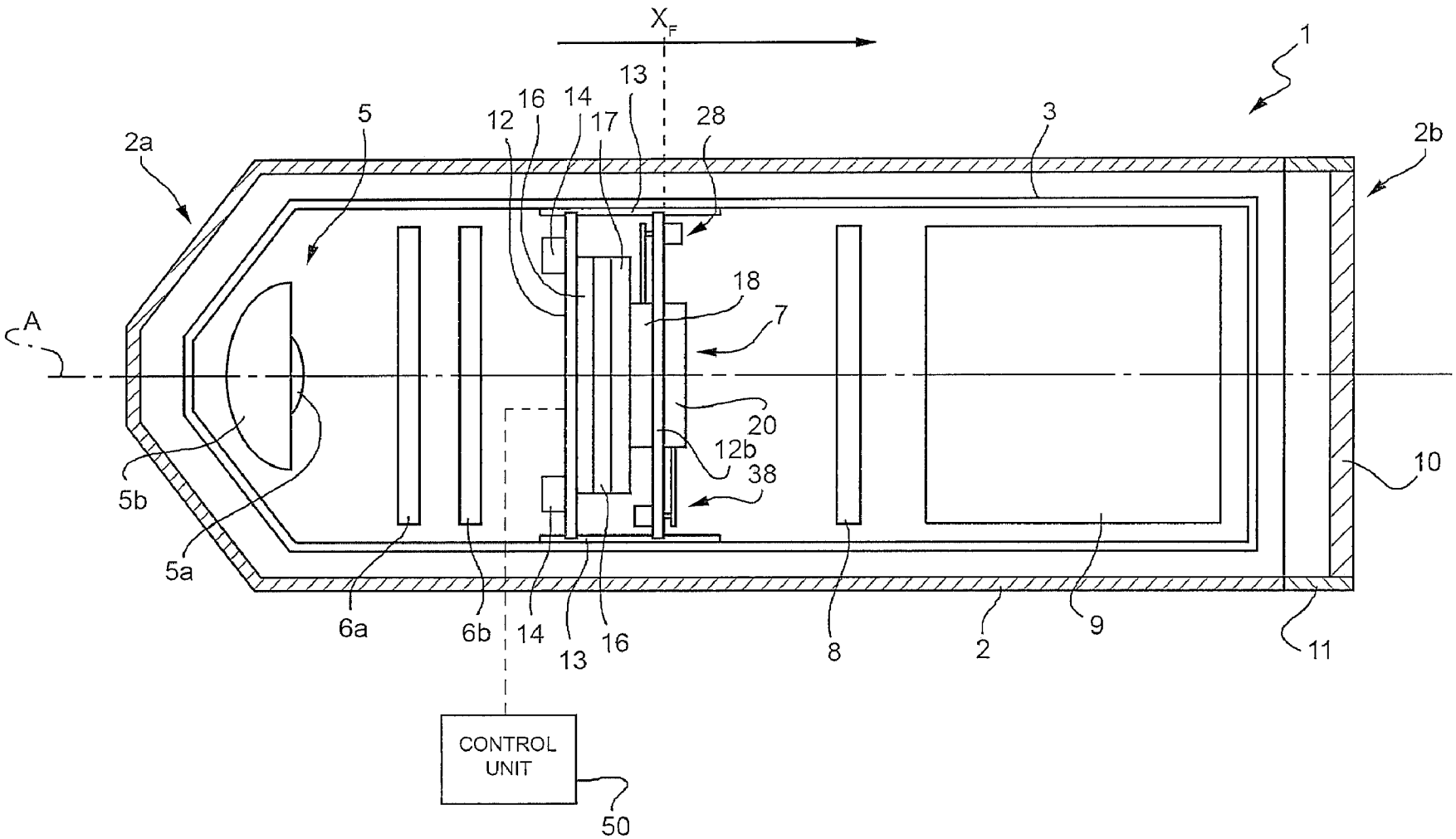
FIG. 1 shows a schematic, longitudinally sectioned side view of a stage lighting fixture in accordance with one embodiment of the present invention.

Number 1 in FIG. 1 indicates as a whole a stage lighting fixture, which comprises a casing 2 extending along a longitudinal axis, and having a closed first end 2*a*, and an opposite open second end 2*b*. On a frame 3, casing 2 houses a light source 5, fixed lighting effect devices 6*a*, 6*b*, a movable lighting effect assembly 7, a beam splitter 8, a zoom assembly 9, and an objective lens 10, which are arranged successively along an optical axis A substantially coincident with the longitudinal axis of casing 2.

Lighting fixture 1 is also equipped with a control unit 50, which, in the embodiment described, is located outside casing 2 and designed to control light source 5, fixed lighting effect devices 6*a*, 6*b*, movable lighting effect assembly 7, beam splitter 8, and zoom assembly 9.

Light source 5 is located close to the closed first end 2*a* of casing 2, and comprises a lamp 5*a*, and a parabolic or elliptic reflector 5*b* designed to form the light from lamp 5*a* into a light beam along optical axis A. The beam travels through fixed devices 6*a*, 6*b*, movable lighting effect assembly 7, and beam splitter 8, and is projected out through zoom assembly 9 and objective lens 10, which is fixed to the open second end 2*b* of casing 2, coaxially with axis A. More specifically, objective lens 10 is fitted to a supporting ring 11 fixed to frame 3; and zoom assembly 9 and objective lens 10 define an objective optical system with a focus at a focus position $X_F$ along optical axis A.

Fixed lighting effect devices 6*a*, 6*b* are fixed to frame 3, between light source 5 and movable lighting effect assembly 7, and are known (e.g. may comprise a dimmer and colour fadeout or colour temperature conversion filters).

Movable lighting effect assembly 7 comprises a plurality of beam filtering and profiling devices fitted to a carriage 12 movable along guides 13 fixed to frame 3.

In the embodiment described, the beam filtering and profiling devices comprise, in succession, a first rotary-gobo plate 15, a fixed-gobo plate 16, a second rotary-gobo plate 17, a circular- or polygonal-aperture diaphragm 18 (hereinafter referred to simply as a circular diaphragm), and an iris diaphragm 20, all described in detail below. It is understood, however, that carriage 12 may be fitted with other types of devices for producing different lighting effects when traversed by the beam.

Carriage 12 is located between light source 5 and objective lens 10, and is driven by on-board electric motors 14 controlled by control unit 50 to move carriage selectively into a plurality of positions along optical axis A. More specifically, carriage 12 may be positioned with one beam filtering and profiling device located at objective optical system focus position $X_F$, and the other beam filtering and profiling devices in respective out-of-focus positions; and may be positioned to use circular diaphragm 18 out of focus, to adjust the intensity of the beam (i.e. as a dimmer).

Beam splitter 8 is located along optical axis A, downstream from movable lighting effect assembly 7, and, in one embodiment, is a rotating prism for dividing the incident beam into a plurality of sub-beams.

Figure 2:
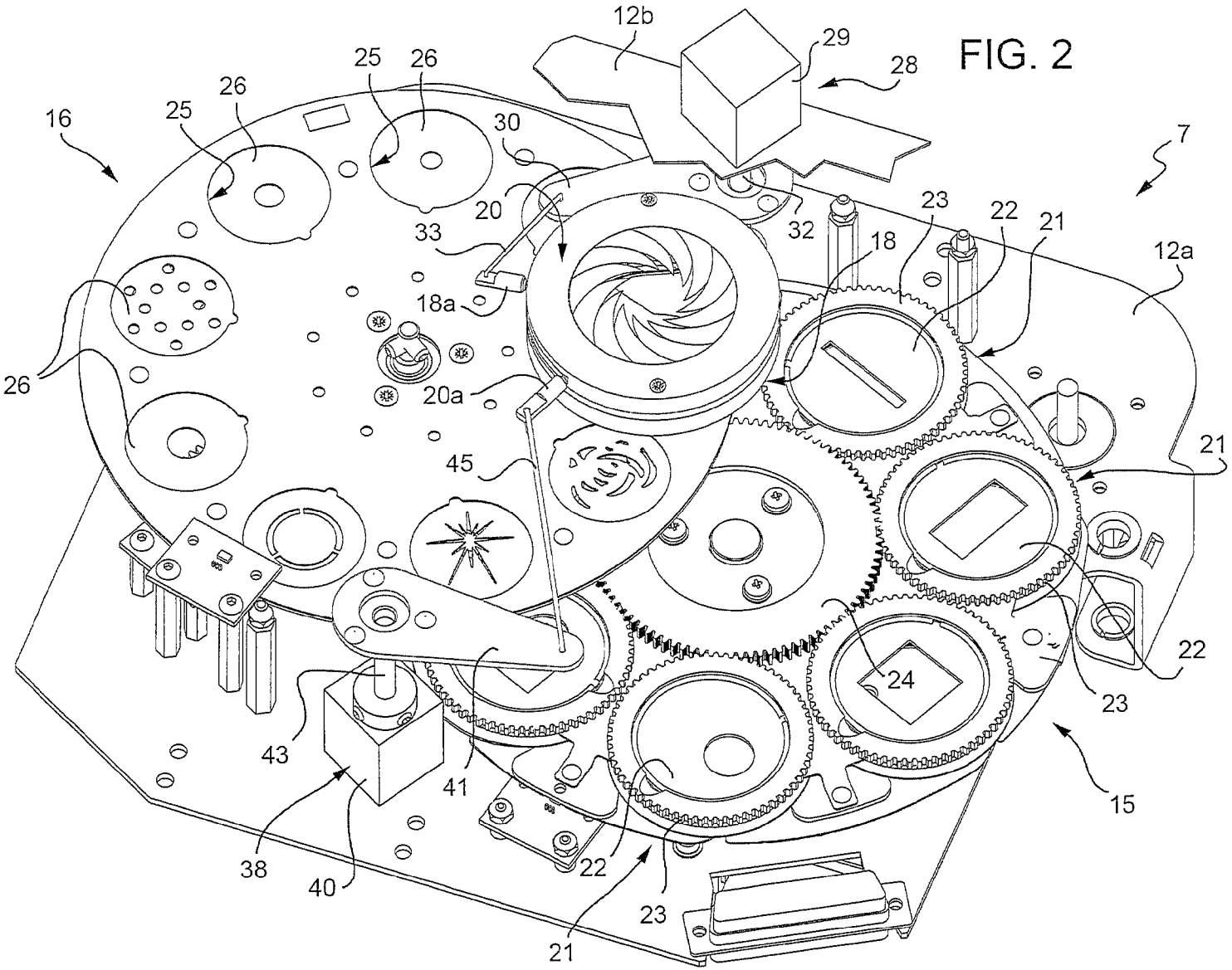
FIG. 2 shows a three-quarter view in perspective, with parts removed for clarity, of a portion of the FIG. 1 lighting fixture.

Going back to the beam filtering and profiling devices, FIG. 2, in which parts are removed for clarity, shows a supporting portion 12*a* of carriage 12, first rotary-gobo plate 15, fixed-gobo plate 16, circular diaphragm 18, and iris diaphragm 20. Supporting portion 12*a* has a central opening (not shown in FIG. 2) to let the beam through.

First rotary-gobo plate 15 is fitted to carriage 12 to rotate about a central axis (not shown) parallel to and offset with respect to optical axis A, and comprises a plurality of gobo holders 21 housing respective gobos 22 and arranged in a circle intersecting optical axis A, so each gobo 22 can be selectively positioned to intercept the beam. Each gobo holder 21 rotates about a respective axis perpendicular to first rotary-gobo plate 15, and has a respective peripheral gear 23, which meshes with a central gear 24 coaxial with and rotated with respect to first rotary-gobo plate 15 by a known actuator not shown. Second rotary-gobo plate 17 is substantially identical to first rotary-gobo plate 15 and therefore not shown.

Fixed-gobo plate 16 is fitted to carriage 12 to rotate about a central axis (not shown) parallel to and offset with respect to optical axis A, and comprises a plurality of seat 25 housing respective fixed gobos 26 and arranged in a circle intersecting optical axis A, so each gobo 26 can be positioned selectively to intercept the beam. Fixed-gobo plate 16 is also operated by an actuator not shown.

Circular diaphragm 18 and iris diaphragm 20 are fitted to a supporting portion 12*b* of carriage 12 (shown schematically in FIG. 1 and only partly in FIG. 2 for the sake of clarity).

Circular diaphragm 18 is a conventional type, is coaxial with optical axis A, and has a control 18*a* for adjusting its aperture. An actuator 28—comprising a step motor 29, a crank 30 fitted to a shaft 32 of step motor 29, and a connecting rod 33 connected to control 18*a*—is controlled by control unit 50 to adjust the aperture of circular diaphragm 18, and is fitted to supporting portion 12*b* of carriage 12 (FIG. 1).

Iris diaphragm 20 is fitted to carriage 12, coaxially with optical axis A and adjacent to circular diaphragm 18.

The term "iris diaphragm" is intended here to mean any diaphragm comprising a plurality of substantially coplanar leaves connected at one end to a supporting frame, and the free ends of which do not overlap, so that, in other than the fully closed position, the free ends of pairs of adjacent leaves are separated by spaces through which light can pass, and the leaves define a non-convex aperture comprising a central region and peripheral regions, defined by non-overlapping ends of adjacent leaves and radiating or spiraling about the central region. Iris diaphragms are known, and are normally used, in out-of-focus positions, in filming or photographic equipment to adjust exposure. and instead of circular diaphragms to attenuate fading, characteristic of circular diaphragms, along the edges of the image.

Figure 3:
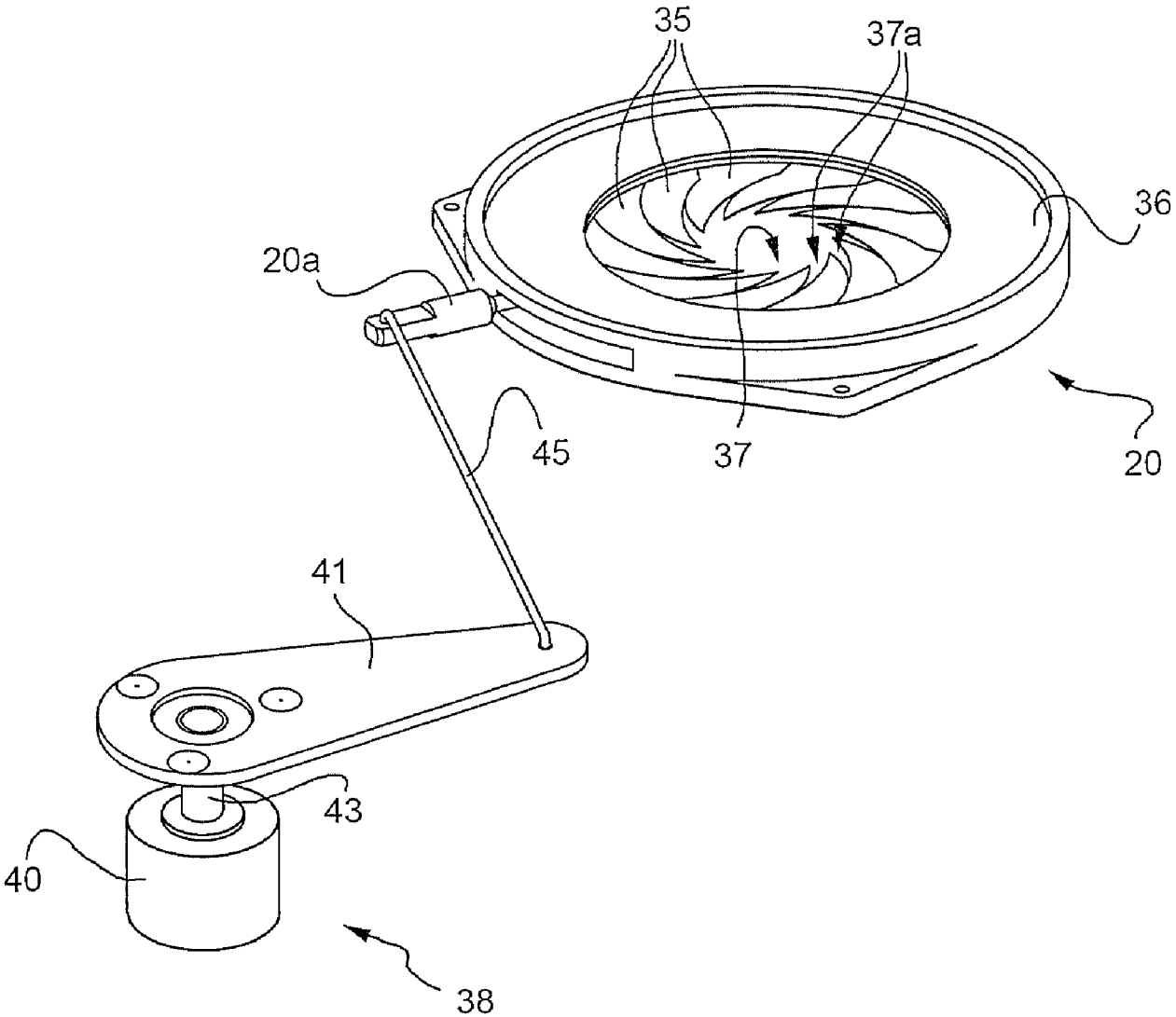
FIG. 3 shows an enlarged three-quarter view in perspective of a detail in FIG. 2 in a first operating configuration.
Figure 4:
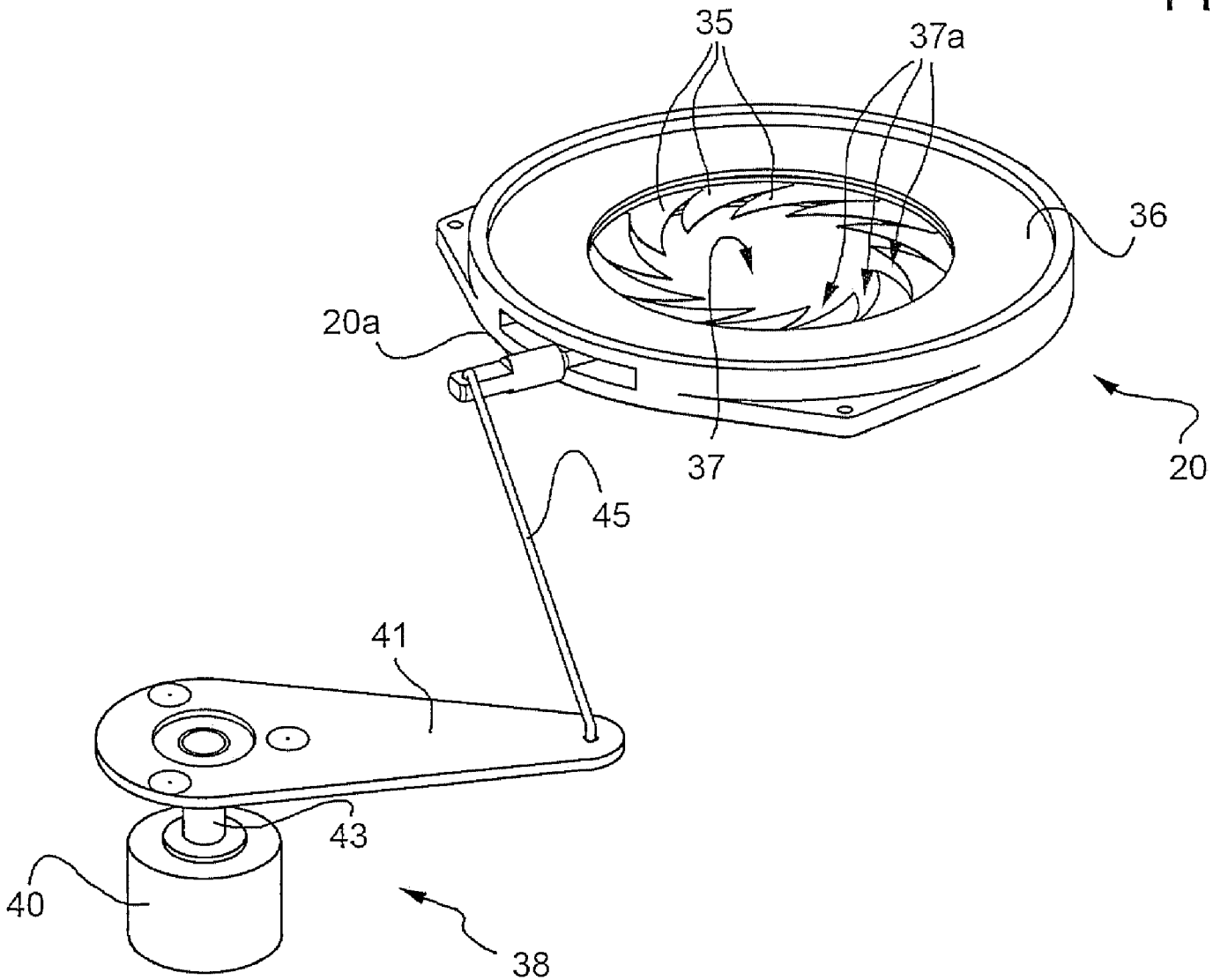
FIG. 4 shows the FIG. 3 detail in a second operating configuration.

In the FIGS. 3 and 4 embodiment, iris diaphragm 20 comprises a plurality of leaves 35 fitted to an annular support 36 so that their respective free ends do not overlap, and which are designed and positioned to define a star aperture 37. More specifically, aperture 37 comprises a clear central region; and spiral-shaped peripheral regions 37*a* defined between non-overlapping portions of adjacent leaves 35. In other words, portions of leaves 35 alternate with peripheral regions 37*a* of aperture 37 along a circle concentric with aperture 37 and larger in radius than the clear central region of aperture 37.

The size of aperture 37 is adjusted by a control 20*a* operated by an actuator 38 fitted to supporting portion 12*b* of carriage 12 (FIG. 1). More specifically, actuator 38 comprises a step motor 40; a crank 41 fitted to a shaft 43 of step motor 40; and a connecting rod 45 connected to control 20*a* controlling iris diaphragm 20. Like motors 14 of carriage 12, and the actuators of the gobo plates and circular diaphragm 18, actuator 38 of iris diaphragm 20 is also controlled by control unit 50, which determines the size and adjustment rate of aperture 37 of iris diaphragm 20. In FIGS. 3 and 4, the iris diaphragm is shown in the minimum- and maximum-aperture configuration respectively.

In actual use, control unit 50 of lighting fixture 1 determines the position of carriage 12 and the devices fitted to it. Whereas circular diaphragm 18 is also used in an out-of-focus position to adjust the intensity of the beam, the first and second rotary-gobo plates 15, 17, fixed-gobo plate 16, and iris diaphragm 20 are used in focus position $X_F$.

More specifically, iris diaphragm 20 is used in focus position $X_F$ to shape the beam to achieve a special effect defined by a projected image of the same configuration as aperture 37; and the size of the projected image is adjustable, like that aperture 37.

When iris diaphragm 20 is in focus position $X_F$, the circular diaphragm is preferably maintained in the maximum-aperture configuration.

Combined with beam splitter 8, the effect can be multiplied to project a plurality of images of the same configuration as aperture 37.

When not in use, iris diaphragm 20 is positioned out of focus, is set to the maximum-aperture configuration, and has substantially no effect on the beam.

Clearly, changes may be made to the lighting fixture and method as described herein without, however, departing from the scope of the present invention, as defined in the accompanying Claims.

In particular, in one embodiment not shown, the iris diaphragm is fixed in the beam focus position.

In another embodiment not shown, the iris diaphragm is seated in a plate, e.g. a gobo plate, and is controlled by a toroidal motor on the plate itself.

In another embodiment not shown, the control unit is housed inside the casing and connectable to the outside by a connector.

The lighting fixture may obviously feature other devices, in addition to or instead of those described, to produce other lighting effects (stroboscopic, wind, etc.). For example, the iris diaphragm may be used in combination with a beam profiler, as opposed (or in addition) to gobo plates.

The invention claimed is:

1. A stage lighting fixture comprising:

a casing having a closed first end and an open second end;

a light source housed inside the casing, close to the first end, to emit a light beam along an optical axis (A);

an objective optical system located along the optical axis, at the second end of the casing, and having a focus position ($X_F$); and a circular-aperture diaphragm located along the optical axis (A), between the light source and the objective optical system, to intercept the beam;

and characterized by an iris diaphragm located along the optical axis (A), between the light source and the objective optical system, and which can be set to the focus position ($X_F$), wherein the iris diaphragm comprises a plurality of substantially coplanar leaves connected at one end to a supporting frame, and free ends thereof do not overlap so that the free ends of pair of adjacent leaves are separated by spaced through which light can pass.

2. A lighting fixture as claimed in claim 1, wherein the circular-aperture diaphragm and the iris diaphragm are movable between the focus position ($X_F$) and respective out-of-focus positions.

3. A lighting fixture as claimed in claim 2, comprising a control unit and positioning means controlled by the control unit for positioning the iris diaphragm alternatively at the focus position ($X_F$) and at least at the respective out-of-focus positions.

4. A lighting fixture as claimed in claim 3, wherein the positioning means comprise a carriage, movable on guides along the optical axis (A), and a motor and wherein the circular-aperture diaphragm and the iris diaphragm are fitted to the carriage.

5. A lighting fixture as claimed in claim 1, comprising an actuator; wherein the iris diaphragm has an adjustable aperture and an aperture control member; and wherein the actuator is connected to the aperture control member of the iris diaphragm.

6. A lighting fixture as claimed in claim 3, comprising an actuator; wherein the iris diaphragm has an adjustable aperture and an aperture control member; wherein the actuator is connected to the aperture control member of the iris diaphragm; and wherein the actuator is controlled by the control unit.

7. A lighting fixture as claimed in claim 6, wherein the control unit is configured to control an adjustment rate of the aperture of the iris diaphragm.

8. A lighting fixture as claimed in claim 1, comprising a beam splitter located along the optical axis (A), between the iris diaphragm and the objective optical system, for splitting the beam into a plurality of sub-beams.

9. A method for operating a stage lighting fixture, comprising:

projecting a light beam from a light source through a circular-aperture diaphragm and an objective optical system aligned with each other along an optical axis (A);

characterized by positioning an iris diaphragm along the optical axis (A), between the light source and the objective optical system, at a focus position ($X_F$) of the objective optical system, wherein the iris diaphragm comprises a plurality of substantially coplanar leaves connected at one end to a supporting frame, and free ends thereof do not overlap so that the free ends of pair of adjacent leaves are separated by spaced through which light can pass.

10. A method as claimed in claim 9, comprising positioning the iris diaphragm alternatively at the focus position ($X_F$) and at least at an out-of-focus position.

11. A method as claimed in claim 9, comprising adjusting an aperture of the iris diaphragm.

12. A method as claimed in claim 11, comprising controlling an adjustment rate of the aperture of the iris diaphragm.

13. A method as claimed in claim 9, comprising splitting the beam into a plurality of sub-beams.

14. A method as claimed in claim 13, wherein splitting the beam comprises placing a beam splitter along the optical axis (A), between the iris diaphragm and the objective optical system.

15. A lighting fixture as claimed in claim 1, wherein the leaves define a non-convex aperture.

16. A lighting fixture as claimed in claim 1, wherein the leaves are configured and positioned to define a star aperture having a clear channel region and spiral-shaped peripheral regions, defined between non-overlapping portions of adjacent leaves.

* * * * *